US006705904B2

(12) United States Patent
Matsuda et al.

(10) Patent No.: US 6,705,904 B2
(45) Date of Patent: Mar. 16, 2004

(54) LEISURE VEHICLE

(75) Inventors: Yoshimoto Matsuda, Kobe (JP); Yuichi Fujii, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/368,980

(22) Filed: Feb. 18, 2003

(65) Prior Publication Data

US 2003/0171044 A1 Sep. 11, 2003

(30) Foreign Application Priority Data

Feb. 19, 2002 (JP) ..... 2002-041380

(51) Int. Cl.[7] ..... B63H 21/22
(52) U.S. Cl. ..... 440/1; 440/84
(58) Field of Search ..... 440/1, 2, 84

(56) References Cited

U.S. PATENT DOCUMENTS 5,171,171 A * 12/1992 Tani ..... 440/1
6,371,819 B1 * 4/2002 Ozawa et al. ..... 440/1
6,648,702 B2 * 11/2003 Nanami et al. ..... 440/1
2001/0051474 A1 * 12/2001 Matsuda et al. ..... 440/1

FOREIGN PATENT DOCUMENTS

JP 11-241636 7/1999

* cited by examiner

*Primary Examiner*—Stephen Avila
(74) *Attorney, Agent, or Firm*—Kolisch Hartwell PC

(57) ABSTRACT

Disclosed is a leisure vehicle comprising a throttle device. The leisure vehicle comprises an engine; a switch operated when the engine starts; and a throttle device for controlling an engine speed of the engine, and the throttle device includes: a throttle operation means for controlling the engine speed; a throttle position sensor for detecting an operation state of the throttle operation means; a throttle valve for opening and closing an air-intake passage of the engine; an actuator for opening and closing the throttle valve; and a control unit for controlling the actuator for opening and closing the throttle valve according to a value of a detection signal output from the throttle position sensor, wherein the control unit is adapted to perform zero setting of the throttle valve such that the throttle valve is operated according to the value of the detection signal with the throttle operation means in a fully closed state, when the switch is operated.

15 Claims, 9 Drawing Sheets

LEISURE VEHICLE

BACKGROUND OF THE INVENTION

1. Field of the Invention

The present invention relates to a leisure vehicle, such as a personal watercraft (PWC) which ejects water rearward and planes on a water surface as the resulting reaction, or an all terrain vehicle (ATV). More particularly, the present invention relates to a throttle device of the leisure vehicle.

2. Description of the Related Art

In recent years, so-called jet-propulsion personal watercraft, which are one type of a leisure vehicle, have been widely used in leisure, sport, rescue activities, and the like. The jet-propulsion personal watercraft is configured to have a water jet pump that pressurizes and accelerates water sucked from a water intake generally provided on a bottom of a hull and ejects it rearward from an outlet port. Thereby, the personal watercraft is propelled.

The water jet pump is driven by an engine mounted in the personal watercraft. The engine is capable of changing an engine speed by operating a throttle operation means of a throttle device. Thereby, the watercraft cruises at a desired speed.

In general, there are two types of throttle devices, i.e., a mechanical-type throttle device and an electric-type throttle device. In the mechanical-type throttle device, an operation force (a force for operating a throttle valve) is transmitted to the throttle valve of the engine through a cable or a rod. In the electric-type throttle device, the throttle valve of the engine is remotely controlled in accordance with an electric signal. In the mechanical-type throttle device, by operating a throttle operation lever, the operation force is directly transmitted to the throttle valve of the engine through the cable. In the electric-type throttle device, a throttle position sensor detects an operation of the throttle operation lever, and an actuator provided on the throttle valve of the engine is activated in accordance with the electric signal, thereby causing the throttle valve to be opened and closed.

When the electric-type throttle device is applied to a watercraft with an engine having multiple cylinders, and in which a plurality of throttle valves are operated, the operation force of the throttle valves are favorably reduced. Nevertheless, since the throttle valve is not operated through the cable or the like, an operation state of the throttle valve at the time when the engine stops affects a state of the throttle valve when the engine re-starts.

In the electric-type throttle device, when the engine stops by turning on a kill switch, the actuator for operating the throttle valve electrically stops regardless of an operation state at that time, and the throttle valve remains under the condition in which the kill switch was turned on.

In general, the engine has its own response characteristic in acceleration. For this reason, when a rider quickly performs a throttle-open operation (i.e., an operation for opening the throttle valve) for the purpose of rapid acceleration of the vehicle, the throttle valve of the engine is quickly opened, and an open area of an air-intake port of the engine is rapidly increased, but an air-intake amount is not increased. This often leads to slow acceleration of the vehicle. In the engine having such a response characteristic, by performing the throttle-open operation more slowly than the above quick throttle-open operation, the acceleration becomes faster.

SUMMARY OF THE INVENTION

The present invention addresses the above described condition, and an object of the present invention is to provide a leisure vehicle having a throttle operation device in which a throttle state at the time when an engine re-starts is not affected by a throttle operation state at the time when the engine stops. Another object of the present invention is to provide a leisure vehicle having a throttle device in which a throttle valve is fully closed even when the engine stops by turning on a kill switch. A further object of the present invention is to provide a leisure vehicle having a throttle device capable of smoothly accelerating even when a throttle operation lever of the throttle device is operated at a speed faster than a predetermined speed.

According to the present invention, there is provided a leisure vehicle comprising: a drive engine; a switch operated when the engine starts; and a throttle device for controlling an engine speed of the engine, the throttle device including, a throttle operation means for controlling the engine speed of the engine, a throttle position sensor for detecting a throttle operation of the throttle operation means, a throttle valve for opening and closing an air-intake passage of the engine, an actuator for opening and closing the throttle valve, and a control unit for controlling the actuator for opening and closing the throttle valve according to a value of a detection signal output from the throttle position sensor; wherein the control unit is adapted to perform zero setting of the throttle valve such that the throttle valve is operated according to the value of the detection signal output from the throttle position sensor with the throttle operation means in a fully closed state, when the switch is operated.

According to the leisure vehicle so constituted, when the throttle valve is open, for example, about 20% of a full throttle state, under the condition in which the engine has stopped, the throttle valve is opened and closed according to the operation state of the throttle operation means when the engine re-starts, which will be described below. The throttle operation means is returned to a fully closed state when released at the re-start of the engine. When the engine re-starts by turning on the switch, the value of the detection signal output from the throttle position sensor is set to zero according to the operation state of the throttle operation means. According to the value (zero) of the detection signal, the control unit controls the actuator to cause the throttle valve to be fully closed according to the value (zero) of the detection signal. As a result, the throttle valve is opened and closed according to the operation state of the throttle operation means when the engine re-starts.

Preferably, the switch may be a main switch of the engine, because the main switch is typically operated when the vehicle re-starts, and therefore zero setting is typically performed.

Preferably, the switch may be a starter switch of the engine, because the starter switch is typically operated when the vehicle re-starts, and therefore zero setting is typically performed. This is advantageous in a leisure vehicle without the main switch.

Preferably, the control unit may be adapted not to turn on a start function of the starter switch for starting the engine until the zero setting of the throttle valve is complete regardless of an ON-state of the starter switch. Thereby, the engine can re-start under a preferable condition in which there is compatibility among the operation state of the throttle operation means, the operation state of the throttle valve, and the value of the detection signal of the throttle position sensor.

Preferably, the control unit may perform zero-calibration when the switch is operated so that the value of the detection signal output from the throttle position sensor becomes zero when the value of the detection signal is lower than a predetermined value with the throttle operation means in a released state. Thereby, when the engine re-starts, the value of the throttle position sensor is adjusted to be zero, and the engine can start with compatibility between the operation state of the throttle valve and the value of the detection signal of the throttle position sensor.

Preferably, the throttle operation means may be provided with a return means for setting the throttle operation means to the fully closed state. Thereby, the throttle device re-starts in a preferable condition in which the value of the detection signal of the throttle position sensor is zero and the throttle operation means is in the fully closed state.

Preferably, the throttle operation means may further include a movable member that moves according to the throttle operation of the throttle operation means, and the return means is a spring for returning the movable member to the fully closed state by a force of the spring.

Preferably, the leisure vehicle may further comprise a kill switch for stopping the engine, wherein the control unit is adapted to control the actuator to cause the throttle valve to be fully closed according to a signal indicating that the kill switch is turned on. Thereby, the engine re-starts under the condition in which there is compatibility among the value of the throttle position sensor, the operation state of the throttle operation means, and the operation state of the throttle valve. In addition, since the throttle valve is fully closed by turning on the kill switch, water or unwanted substances are prevented from entering the air-intake passage of the engine provided with the throttle valve.

Preferably, the control unit may be adapted to control the actuator to cause the throttle valve to operate at a speed slower than an operation speed of the throttle operation means when the throttle operation means is operated at a speed faster than a predetermined speed. Thereby, the throttle valve is opened and closed at the speed compatible with the response characteristic in acceleration of the engine, and consequently, the engine speed increases or decreases smoothly.

Preferably, the leisure vehicle may be a jet-propulsion personal watercraft.

According to the present invention, there is further provided a leisure vehicle comprising: a drive engine; a kill switch for stopping the engine; and a throttle device for controlling an engine speed of the engine, the throttle device including a throttle operation means for controlling the engine speed of the engine, a throttle position sensor for detecting a throttle operation of the throttle operation means, a throttle valve for opening and closing an air-intake passage of the engine, an actuator for opening and closing the throttle valve, and a control unit for controlling the actuator for opening and closing the throttle valve according to a value of a detection signal output from the throttle position sensor, wherein the control unit is adapted to control the actuator to cause the throttle valve to be fully closed according to a signal indicating that the kill switch is turned on.

According to the leisure vehicle so constituted, upon the kill switch being turned on, the air-intake passage provided with the throttle valve is fully closed. This prevents entry of water or substances into the air-intake passage. When the engine re-starts, the throttle valve is fully closed. Therefore, the engine re-starts under the condition in which there is compatibility among the operation state of the throttle operation means, the operation state of the throttle valve, and the value of the detection signal of the throttle position sensor.

Preferably, the kill switch may be an inversion sensor for detecting inversion of the watercraft. When the vehicle is inverted, the kill switch is turned on without being operated by a rider.

Preferably, the leisure vehicle may be a jet-propulsion personal watercraft.

According to the present invention, there is provided a leisure vehicle comprising: a drive engine; and a throttle device for controlling an engine speed of the engine, the throttle device including a throttle operation means for controlling the engine speed of the engine, a throttle position sensor for detecting a throttle operation of the throttle operation means, a throttle valve for opening and closing an air-intake passage of the engine, an actuator for opening and closing the throttle valve, and a control unit for controlling the actuator to cause the throttle valve to be opened and closed according to a value of a detection signal output from the throttle position sensor, wherein the control unit is adapted to control the actuator to operate the throttle valve at a speed slower than an operation speed of the throttle operation means when the throttle operation means is operated at a speed faster than a predetermined speed.

According to the leisure vehicle so constituted, the throttle valve is opened and closed at a speed compatible with the response characteristic of the engine, and therefore, the engine speed increases or decreases smoothly.

Preferably, the leisure vehicle may be a jet-propulsion personal watercraft.

The above and further objects and features of the invention will more fully be apparent from the following detailed description with the accompanying drawings.

BRIEF DESCRIPTION OF THE DRAWINGS

FIG. 7 is a flowchart showing a control procedure with a kill switch of the throttle device in FIG. 1 turned on;

DETAILED DESCRIPTION OF THE PREFERRED EMBODIMENTS

Hereinafter, an embodiment of a personal watercraft of the present invention, which is one type of a leisure vehicle, will be described with reference to the drawings.

Figure 10:
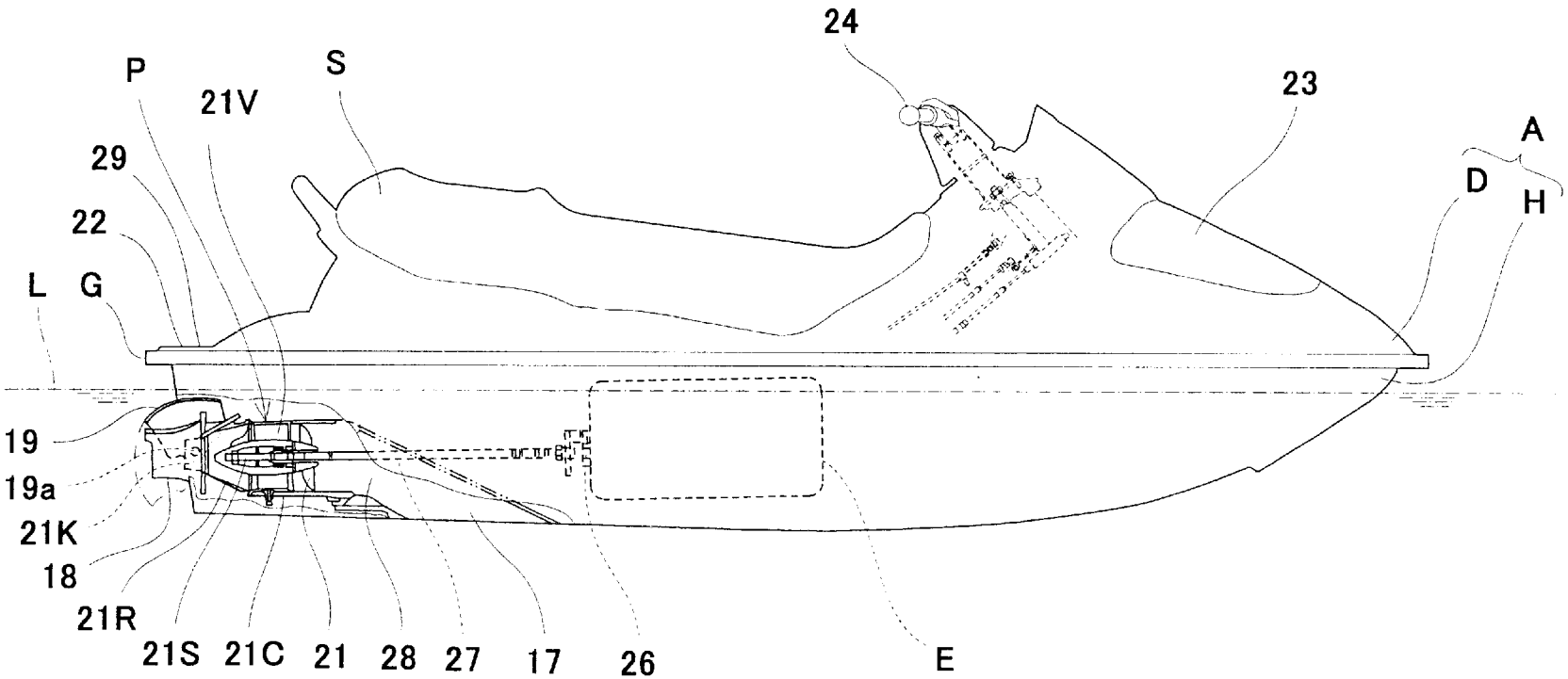
FIG. 10 is a side view of a personal watercraft according to an embodiment of the present invention in which the throttle device in FIG. 1 is mounted.
Figure 11:
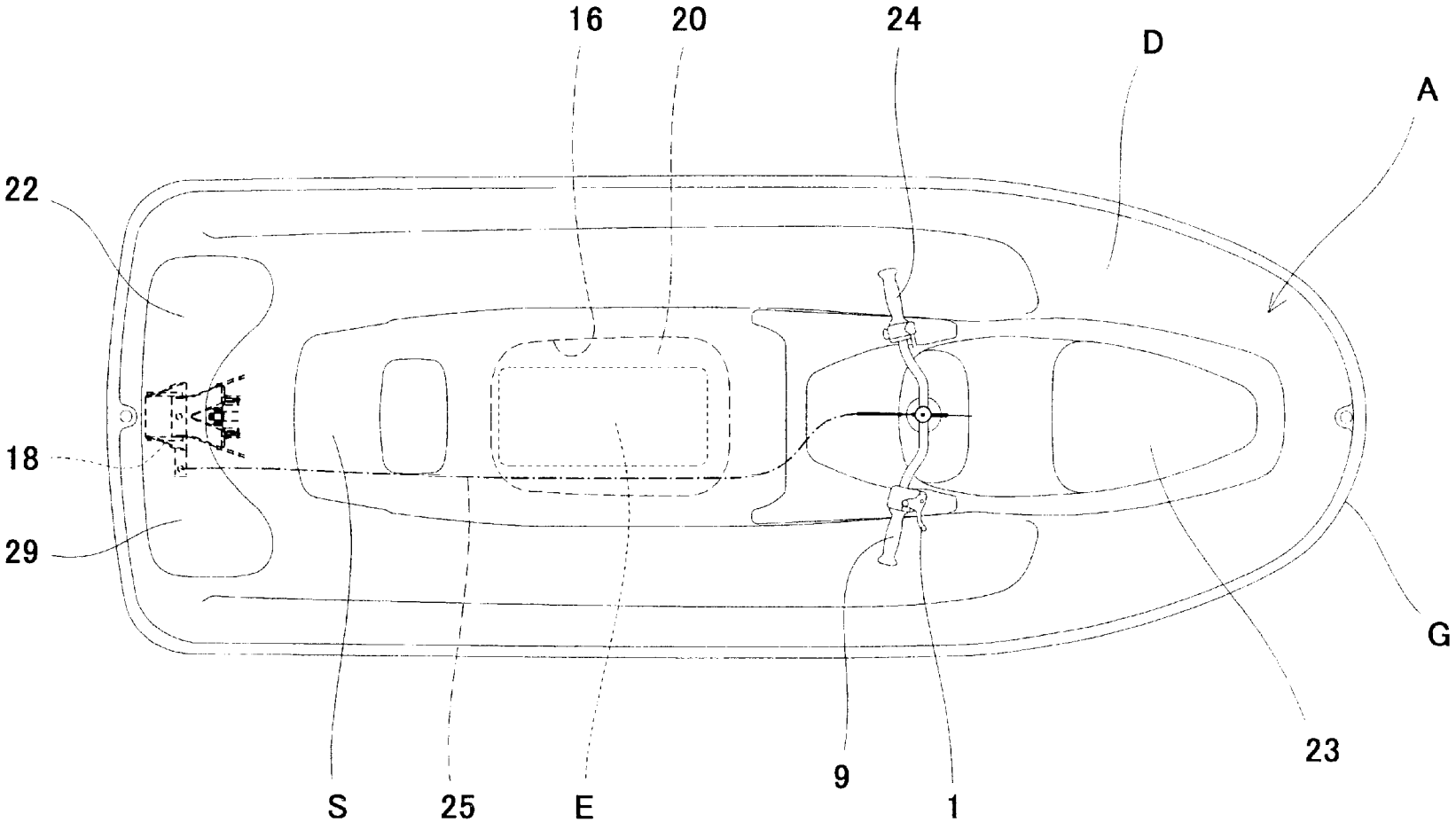
FIG. 11 is a plan view of the personal watercraft in FIG. 10.

Referring now to FIGS. 10 and 11, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 11, an opening 16, which has a substantially rectangular shape seen from above, is formed at a relatively rear section of the deck D such that it extends in the longitudinal direction of the body A, and a straddle-type seat S is mounted above the opening 16 such that it covers the opening 16 from above as shown in FIGS. 10 and 11.

An engine E is contained in a chamber 20 surrounded by the hull H and the deck D below the seat S and having a convex shape in a cross section of the body A.

The engine E is a multiple-cylinder (e.g., four cylinders) four-cycle engine. As shown in FIG. 10, a crankshaft 26 of the engine E is mounted along the longitudinal direction of the body A. An output end of the crankshaft 26 is rotatably coupled integrally with a pump shaft 21S of a water jet pump P through a propeller shaft 27. An impeller 21 is mounted on the pump shaft 21S of the water jet pump P.

The impeller 21 is covered with a pump casing 21C on the outer periphery thereof. A water intake 17 is provided on the bottom of the hull H. The water is sucked from the water intake 17 and fed to the water jet pump p through a water intake passage 28. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining the propulsion force.

In FIG. 10, reference numeral 21V denotes fairing vanes for fairing water flow inside the water jet pump P. In FIGS. 10 and 11, reference numeral 24 denotes a bar-type steering handle. By operating the steering handle 24 to the right or to the left, a steering nozzle 18 provided behind the pump nozzle 21R swings to the right or to the left through a wire cable 25 represented by a dashed line in FIG. 1. The watercraft can be turned to any desired direction while the water jet pump P is generating the propulsion force.

As shown in FIG. 10, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward, and as the resulting reaction, the personal watercraft moves rearward.

In FIGS. 10 and 11, reference numeral 22 denotes a rear deck. The rear deck 22 is provided with an operable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

Figure 1:
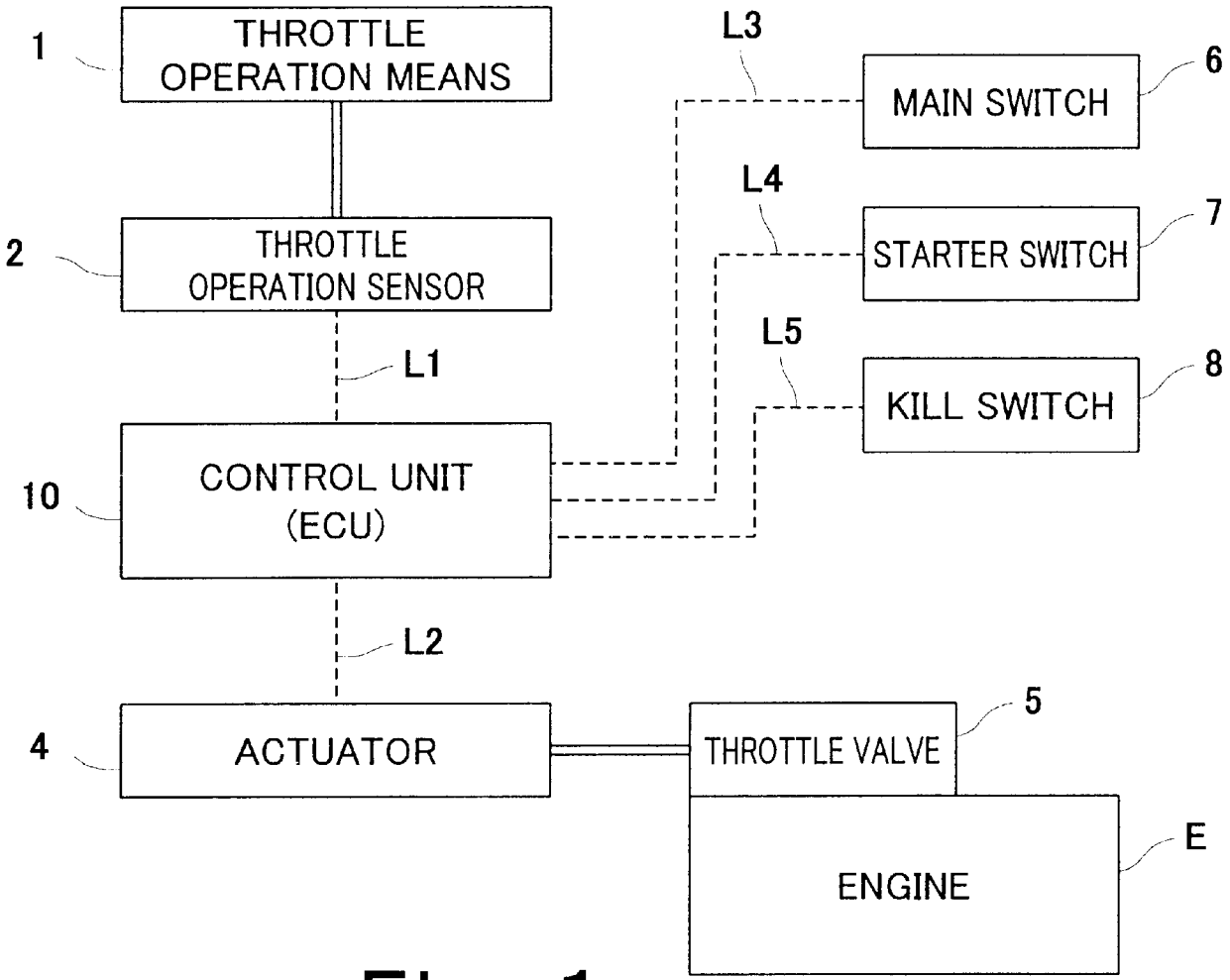
FIG. 1 is a schematic view showing a structure of a throttle device provided in a personal water according to an embodiment of the present invention, and an engine to which the throttle device is mounted.

The personal watercraft according to the embodiment of the present invention comprises a throttle device, shown in FIG. 1. The throttle device is described below.

As shown in FIG. 11, a throttle operation lever (throttle operation means) 1 of the throttle device for controlling an engine speed is attached in the vicinity of a right grip 9 of the steering handle 24, more specifically, at a position of the grip 9 on a body center side.

Figure 2:
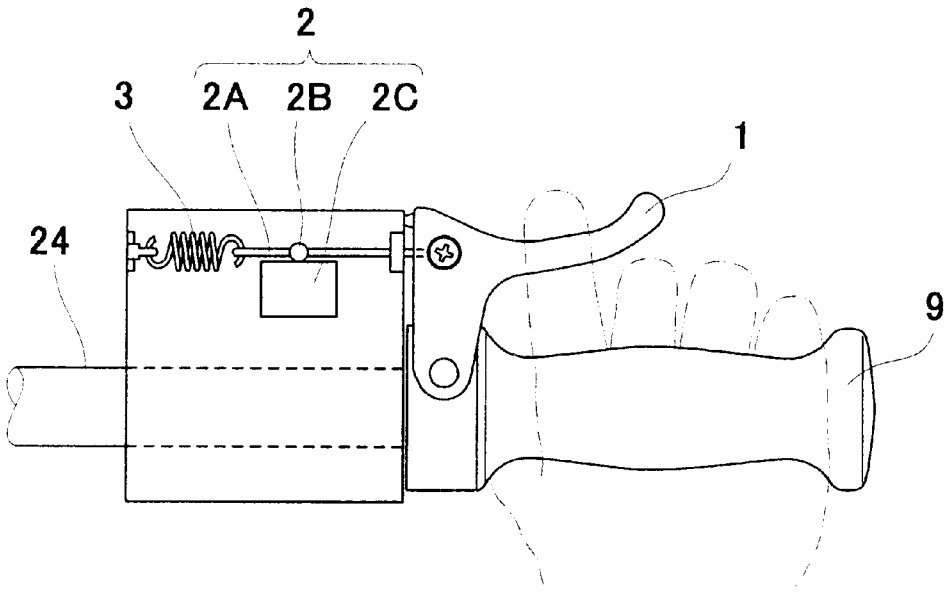
FIG. 2 is a view showing a structure of a throttle operation means in FIG. 1, including a throttle operation lever provided at an end portion of a bar-type handle of the personal watercraft.
Figure 3:
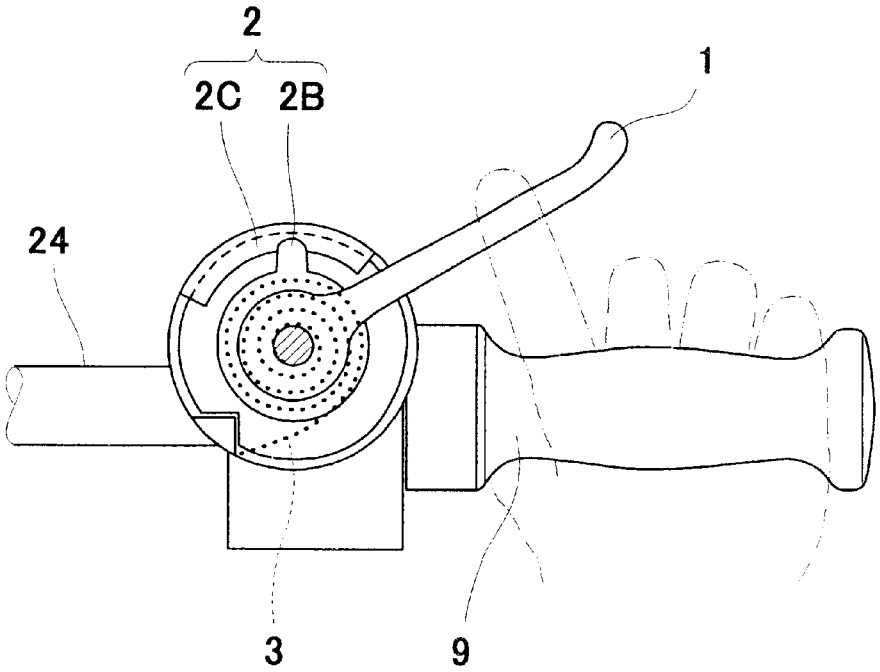
FIG. 3 is a view showing another structure of the throttle operation lever.

As shown in FIG. 2 and FIG. 3, a throttle position sensor 2 is provided on an operating portion adapted to operate according to an operation of the throttle operation lever 1. The throttle position sensor 2 serves to detect an operation of the throttle operation lever 1. Specifically, the throttle position sensor 2 is attached on a cable (movable member) 2A that moves according to the operation of the throttle operation lever 1. In this embodiment, the throttle position sensor 2 is a non-contact sensor. The throttle position sensor 2 is configured such that a permanent magnet as a detected element 2B is attached on the cable 2A and a detecting element 2C is fixed for detecting an operation of the permanent magnet. In an alternative structure shown in FIG. 3, the throttle position sensor 2 is attached to a rotating portion of the throttle operation lever 1. The throttle position sensor 2 in FIG. 3 is configured such that the permanent magnet (detected element 2B) is attached on a base portion of a body of the throttle operation lever 1 and the detecting element 2C is fixed for detecting the operation of the permanent magnet. In both of the throttle operation means shown in FIGS. 2 and 3, the throttle operation lever 1 is adapted to return to a release position (a fully closed state in which the throttle operation lever 1 is in contact with a stopper (not shown) without further movement) by a force of a spring 3 (a coil spring in FIG. 2 and a winding spring in FIG. 3).

As shown in FIG. 1, an output terminal of the throttle position sensor 2 is connected to an input terminal of a control unit 10, i.e., an input terminal of an electric control unit ECU, through a signal line L1 such as an electric wire or an optical fiber cable. Through the signal line L1, a detection signal (detection value) according to the operation state of the throttle operation lever 1, which is output from the throttle position sensor 2, is transmitted to the control unit 10. As a matter of course, another control unit may be provided for the throttle device, apart from the control unit 10. In the configuration in FIG. 1, a double line represents a mechanical connection between associated components and a dashed line represents an electric connection between associated components.

An output terminal of the control unit 10 is connected to an actuator 4 through a signal line L2 such as the electric wire or the optical fiber cable. Through the signal line L2, an operation signal for operating a throttle valve 5 of the engine E, which is obtained by processing the detection signal in the control unit 10, is transmitted to the actuator 4. As the actuator 4, a solenoid type, a motor type, or a hydraulic type may be used.

The actuator 4 is mechanically connected to the throttle valve 5 of the engine E, for opening and closing the throttle valve 5 according to the operation signal.

Figure 4:
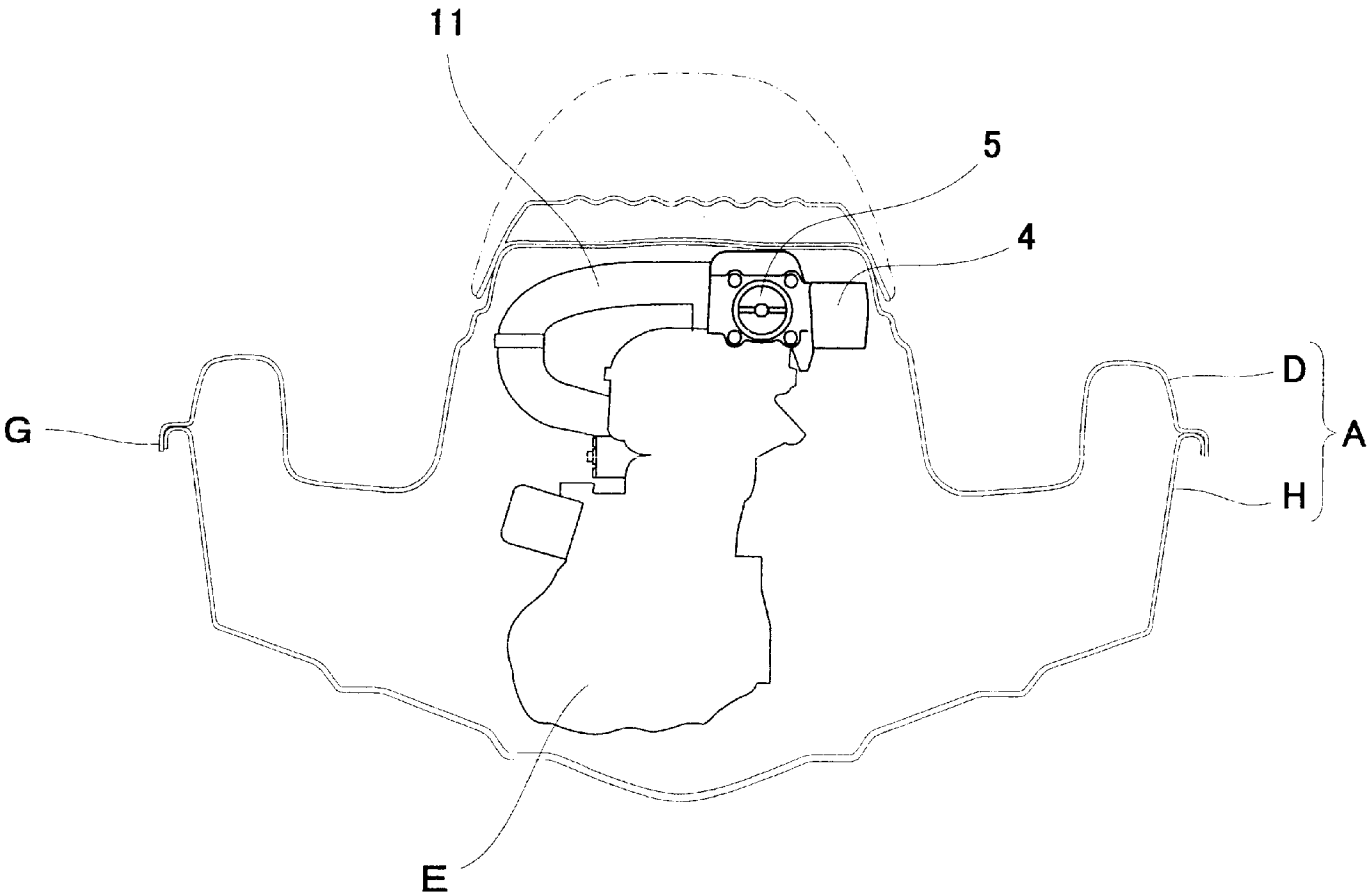
FIG. 4 is a transverse sectional view sectioned along a portion of the watercraft where the engine is mounted, showing a throttle valve provided in an air-intake passage of the engine and an actuator for operating the throttle valve.

As shown in FIG. 4, the throttle valve 5 is openably provided in an air-intake passage 11 of the engine E. The actuator 4 is provided in the vicinity of the throttle valve 5. A drive member of the actuator 4 is connected to a rotating shaft of the throttle valve 5 to rotate the rotating shaft, thereby opening and closing the throttle valve 5.

As shown in FIG. 1, a main switch 6, a starter switch 7, and a kill switch 8 of the personal watercraft are connected to input terminals of the control unit 10 through signals lines L3, L4, and L5, respectively. Upon these switches 6, 7, and 8 functioning, the associated signals are transmitted to the control unit 10.

A memory is built in the control unit 10 and contains a program for controlling the throttle device as described below.

Hereinbelow, the program for controlling the throttle device and a function of the throttle device will be described.

In normal drive (cruising), upon a rider (not shown) operating the throttle operation lever 1 of the handle 24, the control unit 10 outputs the operation signal according to the operation state (operation amount) of the throttle operation lever 1, to the actuator 4, which opens and closes the throttle valve 5 of the engine E. As a result, with an engine power according to the operation state, the watercraft cruises.

Figure 9:
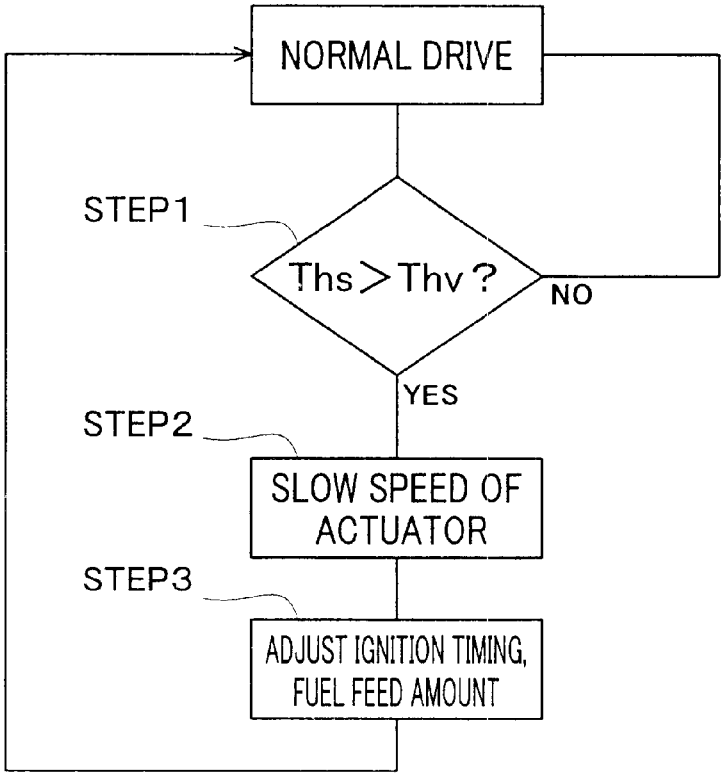
FIG. 9 is a flowchart showing a control procedure of the throttle device to slow the operation speed of the actuator in FIG. 8.

In this state, as shown in a flowchart in FIG. 9, the control unit 10 judges whether or not an operation speed Ths of the throttle operation lever 1 is higher than a predetermined value Thv according to a response characteristic in acceleration of the engine E (Step 1 in FIG. 9).

Figure 8:
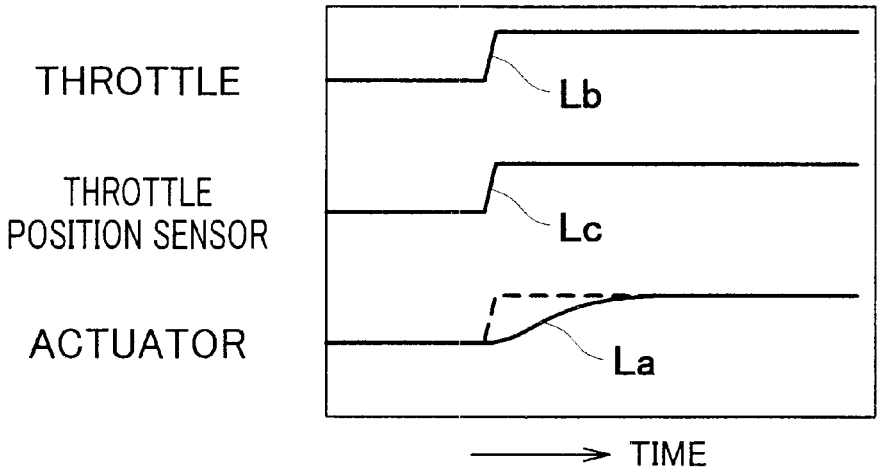
FIG. 8 is a graphic representation with an operation speed of the throttle operation lever, a value of a detection signal output from a throttle position sensor, and an operation speed of an actuator on a longitudinal axis and time with a lateral axis.

When judging that the operation speed Ths is higher than the predetermined value Thv, the control unit 10 causes the actuator 4 to operate at a speed slower than the operation speed of the throttle operation lever 1 (represented by "throttle" in FIG. 8) and a detection speed of the throttle position sensor 2 (represented by "throttle position sensor" in FIG. 8), i.e., at a speed according to the response characteristic in acceleration of the engine E, as shown in FIG. 8 (Step 2 in FIG. 9). Specifically, as shown in a graph in FIG. 8, a line La representing the speed of the actuator 4 changes more gradually than a line Lb representing the operation speed of the throttle operation lever 1 and Lc representing the detection speed of the throttle position sensor 2.

In this embodiment, when the throttle operation lever 1 is operated faster, the control unit 10 further reduces advancement of ignition timing of the engine E and a rate of an increase in a fuel feed amount (Step 3 in FIG. 9). As a result, the engine E increases an engine speed so as to be compatible with its own response characteristic.

Upon the rider releasing the throttle operation lever 1, the control unit 10 detects a signal indicating this release (value of the detection signal is equal to zero), which is output from the throttle position sensor 2, and outputs an operation signal to cause the actuator 4 to close the throttle valve 5, i.e., to cause the engine E to become idle, although this is not shown. At this time, the throttle operation lever 1 returns to the release position by the force of the spring 3.

Figure 5:
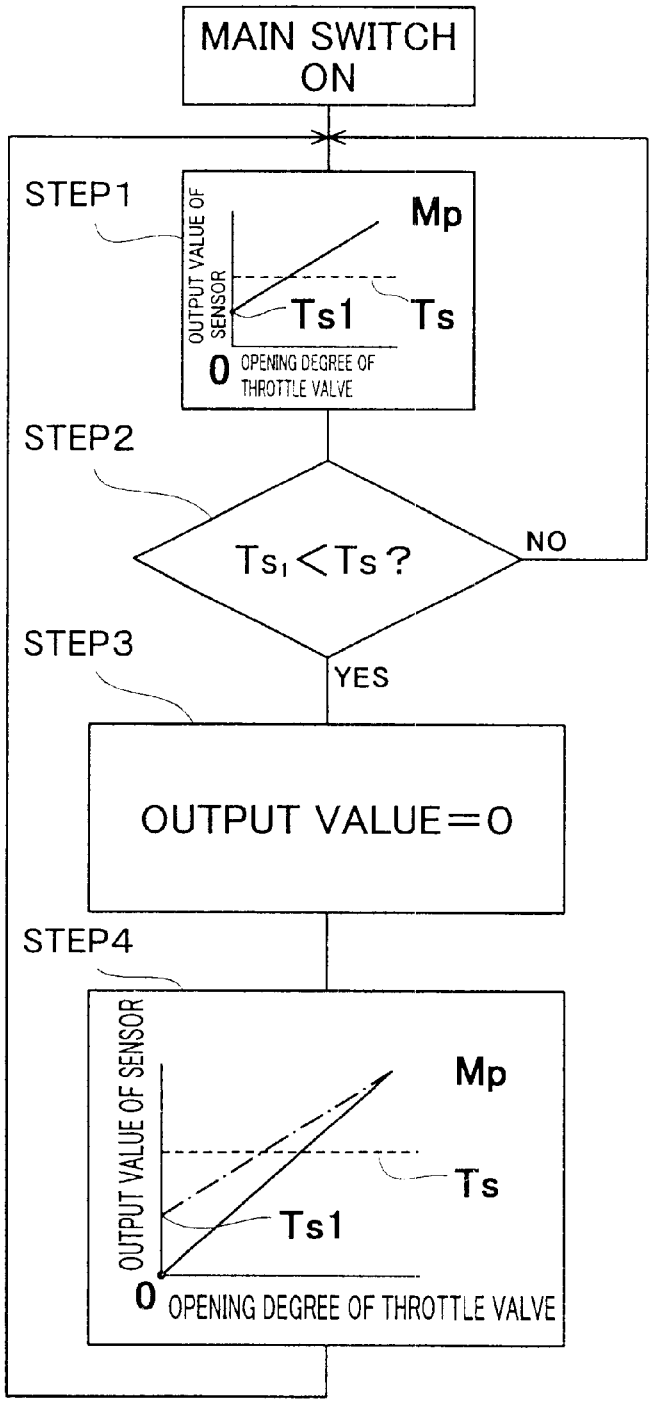
FIG. 5 is a flowchart showing a control procedure of zero-calibration of the throttle device in FIG. 1.

Turning now to FIG. 5, in this state, upon the rider turning on the main switch 6 (starter switch 7) to re-start the engine E, the control unit 10 judges whether or not a value Ts1 of the detection signal output from the throttle position sensor 2 is lower than a predetermined value Ts (Step S2 in FIG. 5). As shown in a default map Mp in Step 1 in FIG. 5, when an opening degree of the throttle valve 5 is zero, a value of the detection signal (an output value of the throttle position sensor 2) is Ts1. When judging that the value Ts1 of the detection signal is lower than the predetermined value Ts, the control unit 10 performs zero-calibration of the sensor output, so that the value Ts1 becomes zero (Step S3).

Then, the control unit 10 stores the resulting zero-adjusted default map Mp (control map for determining the value of the operation signal according to the value of the detection signal) in the memory. In the default map Mp in Step 4 in FIG. 5, a solid line represents a value after the zero-calibration and a dashed line represents a value before the zero-calibration. With reference to the zero-adjusted default map Mp, the control unit 10 outputs an operation signal according to the value of the detection signal output from the throttle position sensor 2, to the actuator 4. As a result, the engine E rotates according to the operation state of the throttle operation lever 1 with compatibility between the operation state of the throttle valve 5 and the value of the detection signal of the throttle position sensor 2.

When the rider turns off the main switch 6 or turn on the kill switch 8 in a non-release state of the throttle operation lever 1, for example, with the throttle operation lever 1 being operated 20% of a full throttle state, the actuator 4 and the throttle valve 5 remain under the condition in which the main switch 6 was turned off or the kill switch 8 was turned on. Meanwhile, the throttle operation lever 1 returns to the release position by the force of the spring 3.

Figure 6:
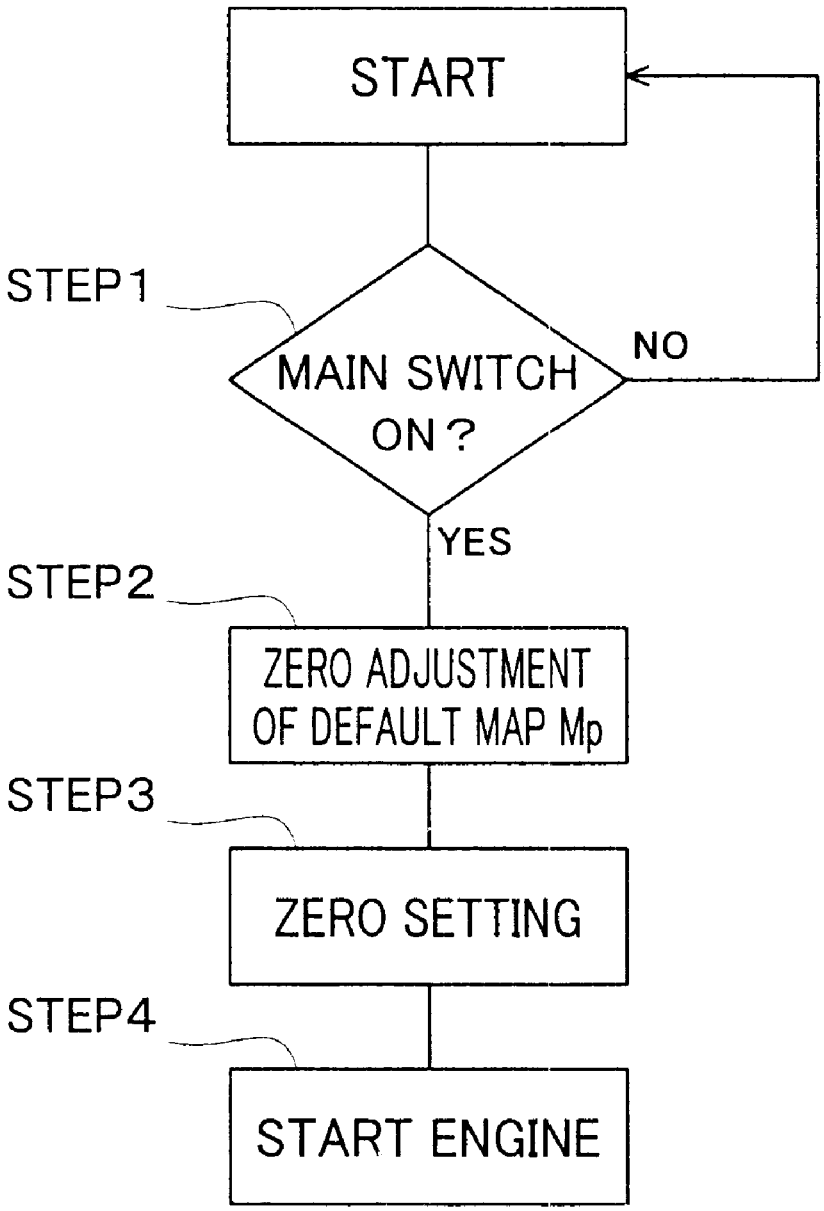
FIG. 6 is a flowchart showing a control procedure of the zero-calibration and zero setting of the throttle device in FIG. 1.

Turning now to FIG. 6, in this state, then, upon the rider turning on the main switch 6 (starter switch 7) (Step 1 in FIG. 6) to re-start the engine E, the control unit 10 is configured to calibrate the output of the sensor by redefining a zero value for the sensor output (zero adjustment in Step S2), and further to set a position of the throttle valve to zero (zero setting in Step S3). Typically, the throttle position sensor output is zero-calibrated electronically at S2, while the throttle valve is mechanically returned to a zero position at S3.

The zero setting of the throttle valve is performed in such a manner that the throttle valve is operated according to the value of the detection signal output from the throttle position sensor 2 with the throttle operation lever at the release position. It should be appreciated that the zero-calibration is performed in the same manner as described above.

By the above zero-calibration of the throttle position sensor output and zero-setting of the throttle valve, it is possible to obtain compatibility among the operation state (release condition) of the throttle operation lever 1, the operation state (fully closed state) of the throttle valve 5, and the value (zero) of the detection signal of the throttle position sensor 2. It will be appreciated that in the prior art, at engine re-start, a gap would exist between actual throttle valve position and reading of the throttle position sensor. According to the present invention, at engine re-start the throttle valve position indicated by the sensor reading will typically match the actual throttle valve position, both being zero.

After the throttle valve has been set to zero, the engine E starts by turning on the starter switch 7 with the main switch 6 in an ON-state (Step 4). Or, with the starter switch 7 in an ON-state, the engine E starts after the zero setting is complete. Actually, time required for zero-calibration of the throttle position sensor output and zero setting of the throttle valve is as short as one second or less.

Accordingly, by turning on the main switch 6 or turning on the starter switch 7 when the engine re-starts, the engine E becomes an idle state.

Figure 7:
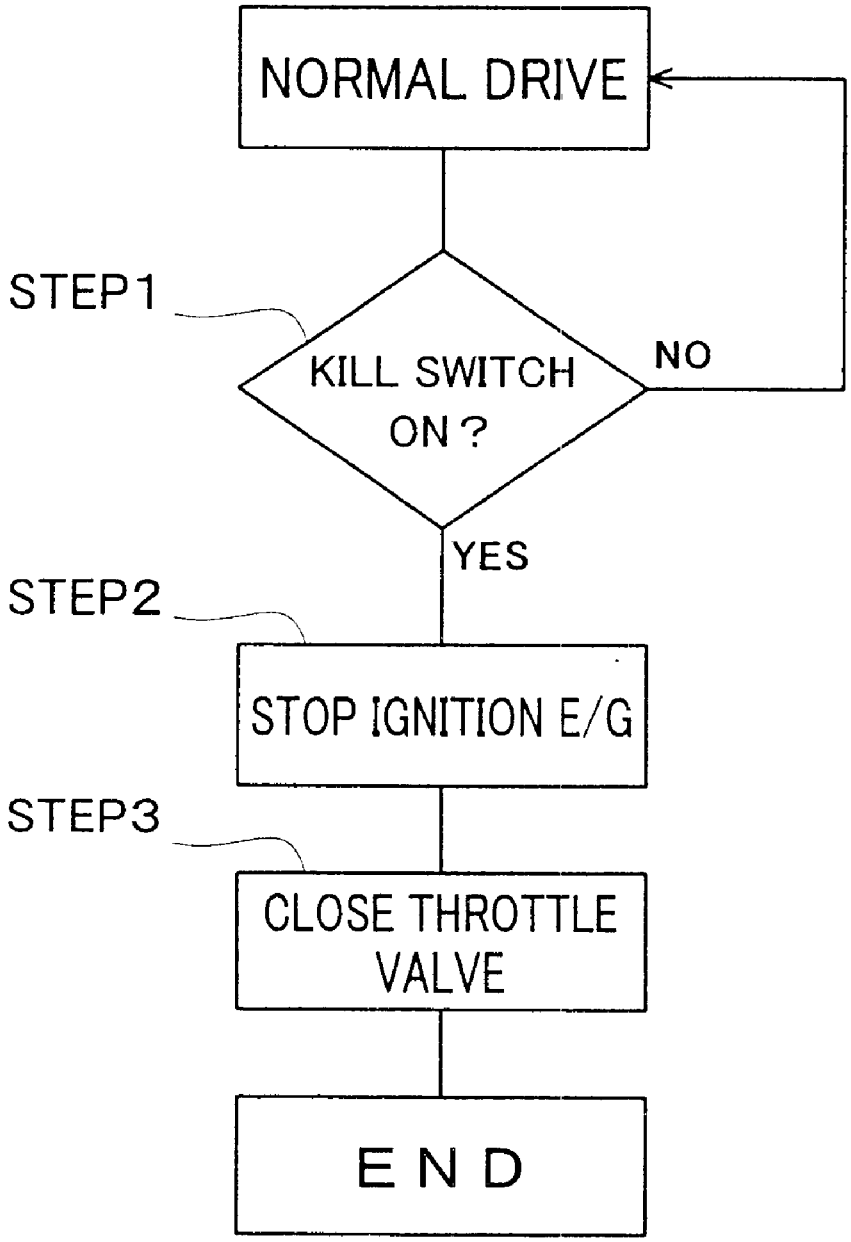

Turning now to FIG. 7, during cruising of the personal watercraft, when the kill switch 8 as a manual switch is turned on and the engine E stops, or the watercraft is inverted and the kill switch 8 automatically stops the engine E, the control unit 10 receives a signal indicating that the kill switch 8 is turned on (Step 1 in FIG. 7). In response to the signal, the control unit 10 stops an ignition signal to the engine E (Step 2 in FIG. 7), and outputs an operation signal to the actuator 4 to cause the throttle valve 5 to be fully closed (Step 3 in FIG. 7).

In this state, the air-intake passage 11 of the engine E is closed by the throttle valve 5. As a result, entry of water or substances into a cylinder of the engine E through the air-intake passage 1 is prevented.

In the case where the kill switch 8 stops the engine E, the above identified zero-calibration of the throttle position sensor output and zero setting of the throttle valve are performed when the engine re-starts. As a result, the engine E re-starts in an idling state.

This far, the jet-propulsion personal watercraft has been described as an example of the leisure vehicle. The present invention is applicable to any other leisure vehicles including an all terrain vehicle, a snow mobile, etc.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A leisure vehicle comprising:

a drive engine;

a switch operated when the engine starts; and a throttle device for controlling an engine speed of the engine, the throttle device including:

a throttle operation means for controlling the engine speed of the engine;

a throttle position sensor for detecting a throttle operation of the throttle operation means;

a throttle valve for opening and closing an air-intake passage of the engine;

an actuator for opening and closing the throttle valve; and a control unit for controlling the actuator for opening and closing the throttle valve according to a value of a detection signal received from the throttle position sensor;

wherein, in response to operation of the switch, the control unit is adapted to set a position of the throttle valve to zero, if the value of the detection signal indicates that the throttle operation means is in a fully closed state.

2. The leisure vehicle according to claim 1, wherein the switch is a main switch of the engine.

3. The leisure vehicle according to claim 1, wherein the switch is a starter switch of the engine.

4. The leisure vehicle according to claim 3, wherein the control unit is adapted not to turn on a start function of the starter switch for starting the engine until the zero setting of the throttle valve is complete regardless of an ON-state of the starter switch.

5. The leisure vehicle according to claim 1, wherein the control unit is configured to perform zero-calibration of an output of the throttle position sensor in response to operation of the switch, so that the value of the detection signal output from the throttle position sensor becomes zero when the value of the detection signal is lower than a predetermined value.

6. The leisure vehicle according to claim 1, wherein the throttle operation means is provided with a return means for setting the throttle operation means to a fully closed state.

7. The leisure vehicle according to claim 6, wherein the throttle operation means further includes a movable member that moves according to the throttle operation of the throttle operation means, and the return means is a spring for returning the movable member to a fully closed state by a force of the spring.

8. The leisure vehicle according to claim 1, further comprising a kill switch for stopping the engine, wherein the control unit is adapted to control the actuator to cause the throttle valve to be fully closed according to a signal indicating that the kill switch is turned on.

9. The leisure vehicle according to claim 1, wherein the control unit is adapted to control the actuator to cause the throttle valve to operate at a speed slower than an operation speed of the throttle operation means when the throttle operation means is operated at a speed faster than a predetermined speed.

10. The leisure vehicle according to claim 1, wherein the leisure vehicle is a jet-propulsion personal watercraft.

11. A leisure vehicle comprising:

a drive engine;

a kill switch for stopping the engine; and a throttle device for controlling an engine speed of the engine, the throttle device including:

a throttle operation means for controlling the engine speed of the engine;

a throttle position sensor for detecting a throttle operation of the throttle operation means;

a throttle valve for opening and closing an air-intake passage of the engine;

an actuator for opening and closing the throttle valve; and a control unit for controlling the actuator for opening and closing the throttle valve according to a value of a detection signal output from the throttle position sensor;

wherein the control unit is adapted to control the actuator to cause the throttle valve to be fully closed according to a signal indicating that the kill switch is turned on.

12. The leisure vehicle according to claim 11, wherein the kill switch is an inversion sensor for detecting inversion of the watercraft.

13. The leisure vehicle according to claim 11, wherein the leisure vehicle is a jet-propulsion personal watercraft.

14. A leisure vehicle comprising:

a drive engine; and a throttle device for controlling an engine speed of the engine, the throttle device including:

a throttle operation means for controlling the engine speed of the engine;

a throttle position sensor for detecting a throttle operation of the throttle operation means;

a throttle valve for opening and closing an air-intake passage of the engine;

an actuator for opening and closing the throttle valve; and a control unit for controlling the actuator to cause the throttle valve to be opened and closed according to a value of a detection signal output from the throttle position sensor;

wherein the control unit is adapted to control the actuator to operate the throttle valve at a speed slower than an operation speed of the throttle operation means when the throttle operation means is operated at a speed faster than a predetermined speed.

15. The leisure vehicle according to claim 14, wherein the leisure vehicle is a jet-propulsion personal watercraft.

* * * * *